US005227693A

United States Patent [19]

Sakakibara et al.

[11] Patent Number: 5,227,693

[45] Date of Patent: Jul. 13, 1993

[54] FLUORESCENT LAMP WITH UV SUPPRESSING FILM AND ITS MANUFACTURING METHOD

[75] Inventors: Yuichi Sakakibara; Keiji Hatakeyama, both of Yokohama; Kunihiko Ikada, Himeji, all of Japan

[73] Assignee: Toshiba Lighting and Technology Corporation, Tokyo, Japan

[21] Appl. No.: 677,328

[22] Filed: Mar. 29, 1991

[30] Foreign Application Priority Data

Mar. 30, 1990 [JP] Japan ..... 2-83858
Mar. 30, 1990 [JP] Japan ..... 2-84346

[51] Int. Cl.[5] ..... H01J 1/70; H01J 61/35; H01J 9/22

[52] U.S. Cl. ..... 313/489; 313/635; 313/493; 427/67; 428/213

[58] Field of Search ..... 313/489, 635, 112, 493; 427/65, 67; 428/213, 328

[56] References Cited

U.S. PATENT DOCUMENTS 2,386,277 10/1945 Smith ..... 313/489
2,774,903 12/1956 Burns ..... 313/489
3,205,394 9/1965 Ray ..... 313/489
4,289,991 9/1981 Schreurs ..... 313/489

FOREIGN PATENT DOCUMENTS 57-132665 8/1982 Japan .
61-110959 5/1986 Japan .
1-20756 5/1989 Japan ..... 313/489

*Primary Examiner*—Donald J. Yusko
*Assistant Examiner*—Michael Horabik
*Attorney, Agent, or Firm*—Cushman, Darby & Cushman

[57] ABSTRACT

A fluorescent lamp including, a bulb having an outer surface and an inner surface, discharge gas contained in the bulb and generating ultraviolet rays by a discharge thereof, a pair of electrodes provided to the bulb for generating the discharge, a phosphor film formed on the inner surface of the bulb and having a non-uniform thickness thereof, and an ultraviolet suppressing film for suppressing the ultraviolet rays formed to be faced with the phosphor film, characterized in that the ultraviolet suppressing film has non-uniform ability for suppressing ultraviolet rays penetrating the phosphor film in accordance with portions thereof to decrease the difference in the intensity of the ultraviolet rays emitted from the ultraviolet suppressing film.

11 Claims, 7 Drawing Sheets

FLUORESCENT LAMP WITH UV SUPPRESSING FILM AND ITS MANUFACTURING METHOD

BACKGROUND OF THE INVENTION

1. Field of the Invention

The present invention relates to a fluorescent lamp.

2. Description of the Related Art

So far, this type of the fluorescent lamp is configured as shown below in order to protect clothing and printed matters from fading due to ultraviolet light.

An ultraviolet suppressing film made of titanium oxide ($TiO_2$) is formed in a bulb and a phosphor film is laminated on the internal surface of the ultraviolet absorbing film or the surface at the discharge space side.

As the result, the ultraviolet light (with the wavelength of approx. 365 nm) produced in the discharge space is interrupted by said ultraviolet suppressing film. Therefore, it is not emitted from the bulb.

This type of the fluorescent lamp is made by the following process.

First, a cleaned bulb is hung by setting the bulb axis vertically. The ultraviolet suppressing material mixture in which titanium-oxide particles are melted is poured into the bulb from the top of the hung bulb.

After the ultraviolet suppressing material mixture is formed on the entire inner surface of the bulb, it is dried by hot air.

Then, the ultraviolet suppressing material mixture is baked in a baking oven to form an ultraviolet absorbing film on the inner surface of the bulb.

And, the phosphor mixture mixed with fluorescent materials to emit three bands of R (red), G (green), and B (blue) is poured onto the inner surface of the ultraviolet suppressing film formed in the bulb from the top of the bulb. Then, the phosphor mixture is dried by hot air. And, the phosphor mixture is baked in the baking oven to laminate phosphor film on the inner surface of the ultraviolet suppressing film.

However, the fluorescent lamp made by the above-mentioned process has the following problem because the ultraviolet suppressing film also suppresses visible radiation.

That is, when the thickness of the ultraviolet suppressing film is increased in order to adequately suppress ultraviolet light, the light output (lumen) of the fluorescent lamp decreases because more visible radiation is suppressed. On the contrary, when the thickness of the ultraviolet suppressing film is decreased to prevent the light output of the fluorescent lamp from decreasing, ultraviolet light is inadequately suppressed.

SUMMARY OF THE INVENTION

It is an object of the present invention to provide fluorescent lamps capable of efficiently controlling ultraviolet light without decreasing the light output of the lamp.

To achieve the object, the fluorescent lamp of the present invention comprises a fluorescent lamp comprising: a bulb having an outer surface and an inner surface; discharge gas contained in said bulb and generating ultraviolet rays by a discharge thereof; a pair of electrodes provided to said bulb for generating said discharge; a phosphor film formed on the inner surface of said bulb and having a non-uniform thickness thereof; and an ultraviolet suppressing film for suppressing said ultraviolet rays formed to be faced with said phosphor film, said ultraviolet suppressing film having non-uniform ability for suppressing ultraviolet rays penetrating said phosphor film in accordance with portions thereof to decrease the difference in the intensity of the ultraviolet rays emitted from said ultraviolet suppressing film.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The fluorescent lamp of the first embodiment of the present invention is described below according to FIGS. 1A through 2.

Figure 1A:
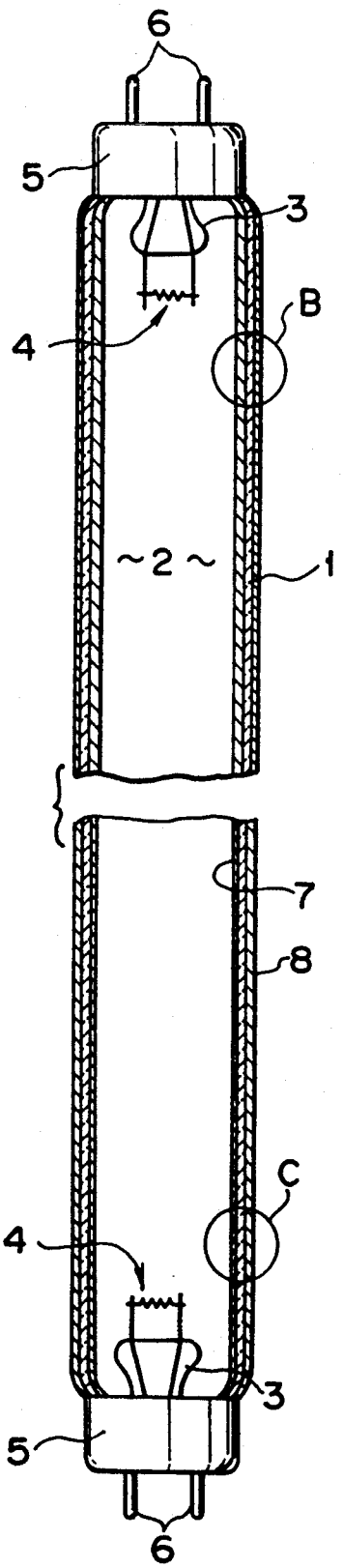
FIG. 1A is a sectional view of the fluorescent lamp in the first embodiment of the present invention.

FIG. 1A shows a three-band emission-type fluorescent lamp of Type FL20SS.EX-N/18. This type of fluorescent lamp of this embodiment comprises a straight-tubular glass bulb 1. The diameter of the bulb 1 is approx. 28 mm and the length of it is approx. 580 mm. The inside of the bulb 1 is provided with a discharge space 2. Both ends of the bulb 1 are closed by a stem 3. Each of the stems 3 has a filament electrode 4. A base 5 is installed on the both ends of the bulb 1. A pair of pins 6 respectively connected to said electrode 4 is installed on each of the bases 5.

A phosphor film 7 is formed on the inner surface of the bulb 1.

The phosphor film 7 is mainly made of three-band fluorescent materials. The three-band fluorescent material is made by mixing the phosphors emitting blue, green, and red lights. The phosphor for emitting blue light includes "(Ba, Mg) 0.8 $Al_2O_3$: Eu" whose luminous peak is present at the wavelength of approx. 450 nm. The phosphor for emitting green light includes "$LaPO_4$: Ce, Tb" whose luminous peak is present at the wavelength of approx. 540 nm. The phosphor for emitting red light includes "$Y_2O_3$: Eu" whose luminous peak is present at the wavelength of approx. 610 nm.

The bulb 1 contains a certain amount of inert gas such as mercury or argon gas.

An ultraviolet suppressing film 8 is formed on the outer surface of the bulb 1.

The ultraviolet suppressing film 8 is made by mixing particles of the titanium oxide ($TiO_2$) and those of zinc oxide (ZnO).

The particle diameter of titanium oxide approximately ranges between 0.03 and 0.05 μm and that of zinc oxide between 0.0015 and 0.005 μm.

This type of fluorescent lamp is made by the following process.

First, the cleaned bulb 1 is hung by setting the bulb axis vertically. The phosphor mixture in which three-band fluorescent material or binder is dispersed or melted is poured onto the inner surface of the bulb 1 from one end of the bulb 1, that is, from the top of the hung bulb 1. After said phosphor mixture is formed on the entire inner surface of the bulb 1, the solvent is evaporated by blowing hot air on the outside of the bulb 1 with it hung. Then, the bulb 1 is horizontally set to bake the coated film in the baking oven and the binder is removed to form the phosphor film 7 on the inner surface of the bulb 1.

Then, a mount with an electrode at the both ends of it is sealed on the bulb 1 having the phosphor film 7 thus formed. The bulb 1 is exhausted through an exhaust tube installed on the mount and filled with a small amount of noble gases such as Hg and argon.

The exhaust process is executed in an exhaust furnace.

After the bulb is filled with Hg and argon, the exhaust tube is chipped off. Then, a base 5 is installed at the both ends of the bulb 1. In this stage, an ordinary fluorescent lamp is finished.

The fluorescent lamp of the present invention is further transferred to the process for forming the ultraviolet suppressing film 8 as mentioned later.

That is, the bulb 1 with the phosphor film 7 formed is vertically hung similarly to the time the phosphor film 7 is formed. In this case, the bulb 1 should be hung inversely when the phosphor film 7 is applied, that is, so that the upper side when the phosphor mixture is applied will be brought to the lower side. The reason is mentioned later.

Then the bulb 1 is hung again by setting the bulb axis vertically. Then, the ultraviolet suppressing material mixture in which particles of titanium oxide and zinc oxide and binder are dispersed o melted is poured onto the outer surface of the bulb 1 from the other end of the bulb 1, that is, from the top of the hung bulb 1. After the ultraviolet suppressing material mixture is formed on the entire outer surface of the bulb 1, the solvent is evaporated by blowing hot air from the outside of the bulb 1. Then, the coated film is baked in the baking oven and binder is removed to form the ultraviolet suppressing film 8 on the outer surface of the bulb 1.

The phosphor film 7 formed as mentioned above is the thinnest at said one end of the bulb 1 and the thickest at the other end of it. From FIG. 1A, it is found that the thickness $X_1$ of the phosphor film 7 at the portion B (see FIG. 1B) is larger than the thickness $X_2$ of the phosphor film 7 at the portion C (see FIG. 1C) (i.e., $X_1 > X_2$).

The reason originates in the forming process of the phosphor film 7. That is, when said phosphor mixture is applied, the applied solution drips from the top to the bottom of the bulb 1 until it is dried because the bulb 1 is vertically held. Therefore, the phosphor film 7 is thinly formed at the top of the bulb 1 and thickly formed at the bottom of it.

The ultraviolet suppressing film 8 formed as mentioned above, unlike said phosphor film 7, is the thickest at said one end of the bulb 1 and the thinnest at the other end of it. From FIG. 1A, it is found that the thickness $Y_1$ of the ultraviolet suppressing film 8 at the portion B (see FIG. 1B) is smaller than the thickness $Y_2$ of the ultraviolet suppressing film 8 at the portion C (see FIG. 1C) (i.e., $Y_1 < Y_2$). The reason is the same as the cause in which the thickness difference occurs in the phosphor film 7.

Consequently, the thick portion (shown by $X_1$ in the drawing) of the phosphor film 7 faces the thin portion (shown by $Y_1$ in the drawing) of the ultraviolet suppressing film 8. Also, the thin portion (shown by $X_2$ in the drawing) of the phosphor film 7 faces the thick portion (shown by $Y_2$ in the drawing) of the ultraviolet suppressing film 8.

For the fluorescent lamp of this embodiment, the fluorescent material of the phosphor film 7 is stimulated by the ultraviolet (with the wavelength of approx. 365 nm) produced in the discharge space 2 while the lamp lights up. As the result, visible radiation is emitted from the phosphor film 7 to the outside by penetrating the bulb 1 and ultraviolet suppressing film 8.

In this case, the ultraviolet rays produced in the discharge space 2 is not completely converted into visible radiation by the phosphor film 7. Part of the ultraviolet rays penetrates the phosphor film 7. The amount of the ultraviolet penetrating the film 7 depends on the thicknesses $X_1$ and $X_2$ of the phosphor film 7 (see FIGS. 1B and 1C).

Figure 1B:
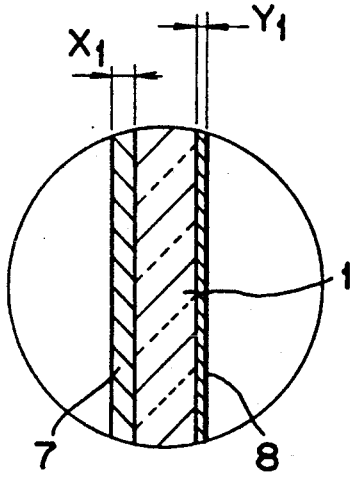
FIG. 1B is an enlarged sectional view of the portion B in FIG. 1A.
Figure 1C:
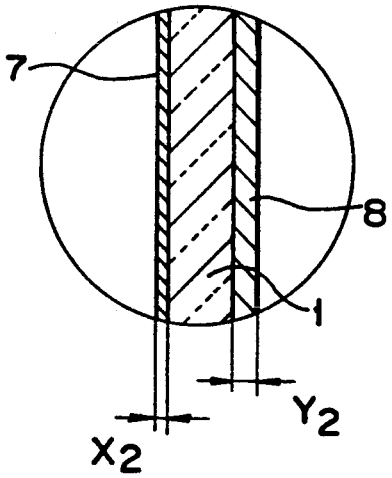
FIG. 1C is an enlarged sectional view of the portion C in FIG. 1A.

This is, only a small amount of ultraviolet rays penetrates the thick portion of the phosphor film 7 (see FIG. 1B), while a large amount of ultraviolet rays penetrate the thin portion of the phosphor film 7 (see FIG. 1C).

The ultraviolet rays penetrating the phosphor film 7 is suppressed by the ultraviolet suppressing film 8 formed on the outer surface of the bulb 1.

The amount of the ultraviolet rays to be suppressed also depends on the thicknesses $Y_1$ and $Y_2$ of the ultraviolet suppressing film 8 (see FIGS. 1B and 1C).

That is, only a small amount of ultraviolet rays are suppressed at the thin portion of the ultraviolet suppressing film 8 (see FIG. 1B), while a large amount of ultraviolet rays are suppressed at the thick portion of the ultraviolet suppressing film 8 (see FIG. 1C).

As described above, for the fluorescent lamp of this embodiment, the thick portion of the phosphor film 7 faces the thin portion of the ultraviolet suppressing film 8 (see FIG. 1B) and the thin portion of the phosphor film 7 faces the thick portion of the ultraviolet suppressing film 8 (see FIG. 1C).

Therefore, a large amount of ultraviolet rays penetrating the thin portion of the phosphor film 7 reaches the thick portion of the ultraviolet suppressing film 8 (see FIG. 1C). Consequently, said large amount of ultraviolet rays are adequately suppressed by the thick ultraviolet suppressing film 8. Thus, no ultraviolet rays are emitted to the outside. Meanwhile, a small amount of ultraviolet rays penetrating the thick portion of the phosphor film 7 reaches the thin portion of the ultraviolet suppressing film 8 (see FIG.1B). Consequently, said small amount of ultraviolet rays is adequately suppressed by the thin ultraviolet suppressing film 8. Therefore, ultraviolet rays are adequately suppressed even if the ultraviolet suppressing film 8 has thickness difference.

Figure 2:
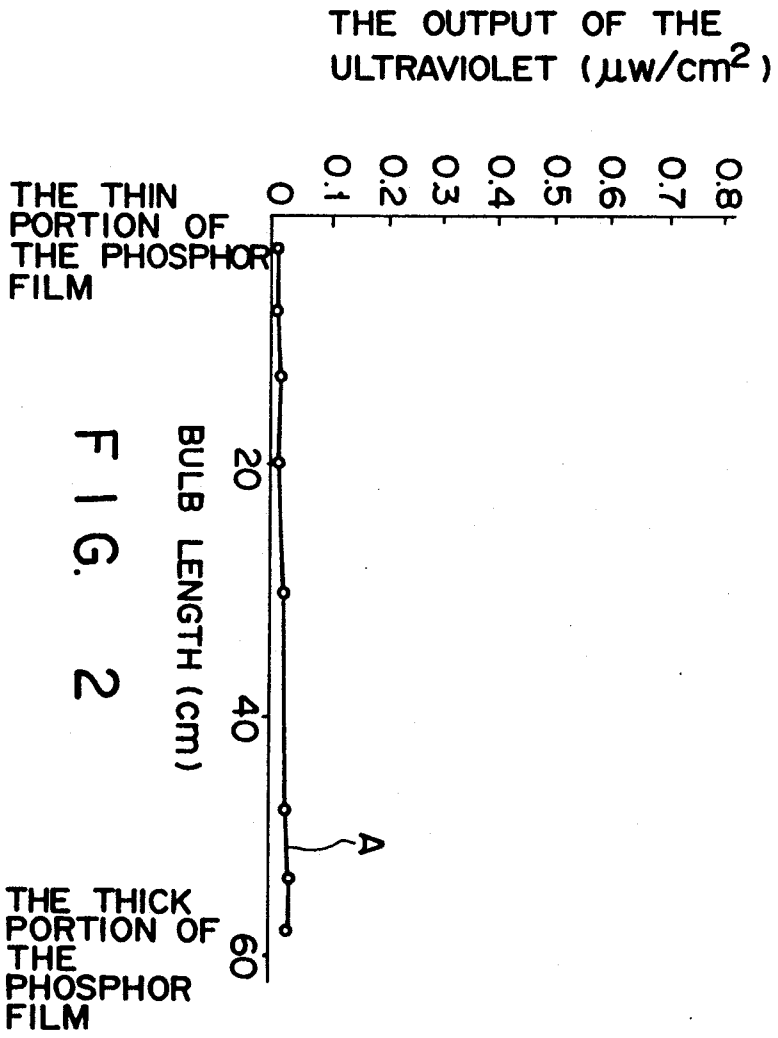
FIG. 2 is a characteristic diagram showing the output of the ultraviolet emitted from the fluorescent lamp in FIG. 1A.

FIG. 2 shows the ultraviolet output characteristic curve of the fluorescent lamp of this embodiment.

For the fluorescent lamp of this embodiment, it is found from this graph that the ultraviolet output is maintained at a low value throughout the bulb.

The ultraviolet output value shown by the graph in FIG. 2 can be decreased and it is not necessary to extremely thickly form the ultraviolet suppressing film 8. Therefore, light is not greatly suppressed by the ultraviolet suppressing film 8 or the light output (lumen) of the fluorescent lamp does not decrease.

The forming process of the above-mentioned ultraviolet suppressing film 8 is executed after the ordinary fluorescent lamp is finished. Therefore, there is the advantage that the manufacturing equipment and process of the ordinary fluorescent lamp do not have to be changed. Also, the ultraviolet suppressing film 8 can simply be formed by only forming a film on the outer surface of the bulb 1. In addition, because film thickness difference is formed through the process in which the ultraviolet suppressing material mixture is applied to the bulb 1 by vertically holding the bulb similarly to the forming of the phosphor film 7, there is the advantage that the ultraviolet suppressing material film 8 can very simply be formed without any special means.

Moreover, because the ultraviolet suppressing film 8 used for the fluorescent lamp of this embodiment is made of titanium oxide ($TiO_2$) and zinc oxide (ZnO), it is possible to keep the decrease of said light output (lumen) smaller and improve the suppression of ultraviolet.

Because the existing ultraviolet suppression film is made of only titanium oxide ($TiO_2$). The titanium oxide is superior in ultraviolet suppression but has the characteristic to slightly suppress visible radiation. Therefore, there is a problem that light output (lumen) slightly decreases.

However, the ultraviolet suppressing film 8 of this embodiment is made by mixing titanium oxide ($TiO_2$) and zinc oxide (ZnO). Zinc oxide has a large transmittance of visible radiation. Therefore, the transmittance of visible radiation is improved compared with the existing ultraviolet suppressing film. Consequently, the light output (lumen) is improved.

However, zinc oxide is slightly inferior to titanium oxide in ultraviolet suppression. For this reason, when the thickness of the ultraviolet suppressing film 8 of this embodiment increases, the amount of ultraviolet light to be suppressed decreases. Therefore, it is preferable to decrease the thickness of the ultraviolet suppressing film 8 as small as possible. By forming the film as thin as possible, the transmittance of visible radiation can be improved.

Also for the ultraviolet suppressing film 8 mixed with zinc oxide and titanium oxide of this embodiment, the film strength is improved because the particle diameter of zinc oxide is different from that of titanium oxide. Thus, the ultraviolet suppressing film 8 formed on the outer surface of the bulb 1 is not easily separated from the bulb 1.

The fluorescent lamp of this embodiment is not restricted to the above-mentioned configuration. For example, the ultraviolet suppressing film 8 can be configured by titanium oxide as ever.

Moreover, the ultraviolet suppressing film 8 can be formed between the inner surface and the phosphor film 7 of the bulb 1.

Figure 3:
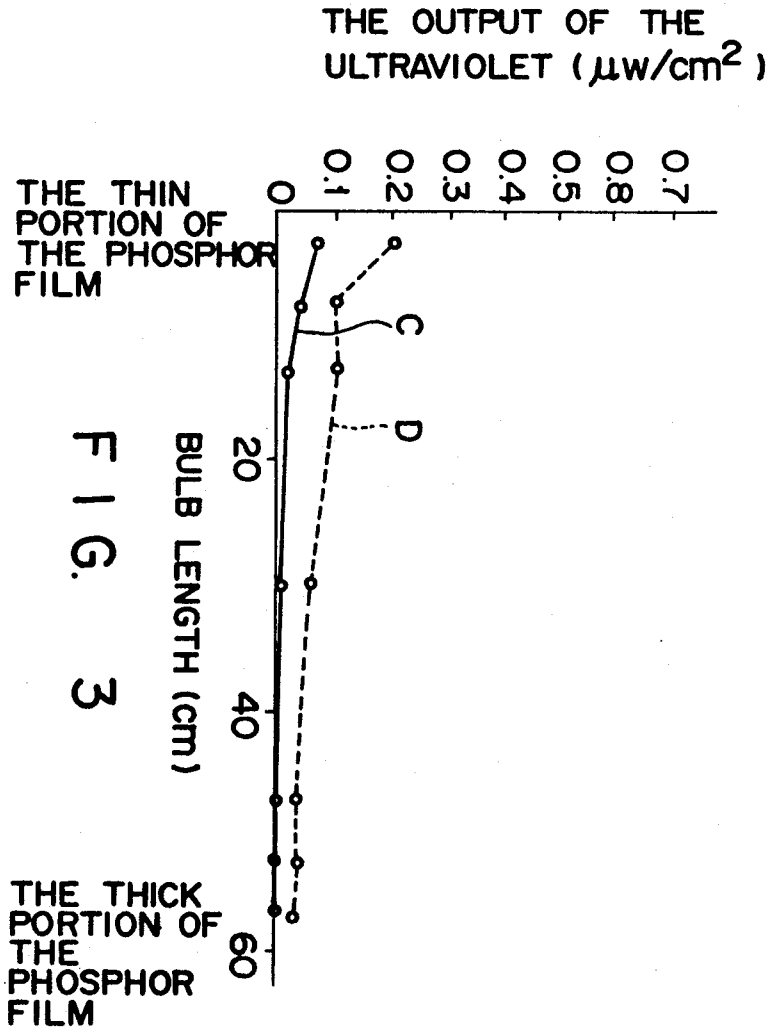
FIG. 3 is a characteristic diagram obtained by changing the density of the ultraviolet suppressing film formed on the fluorescent lamp in FIG. 1A.
Figure 4:
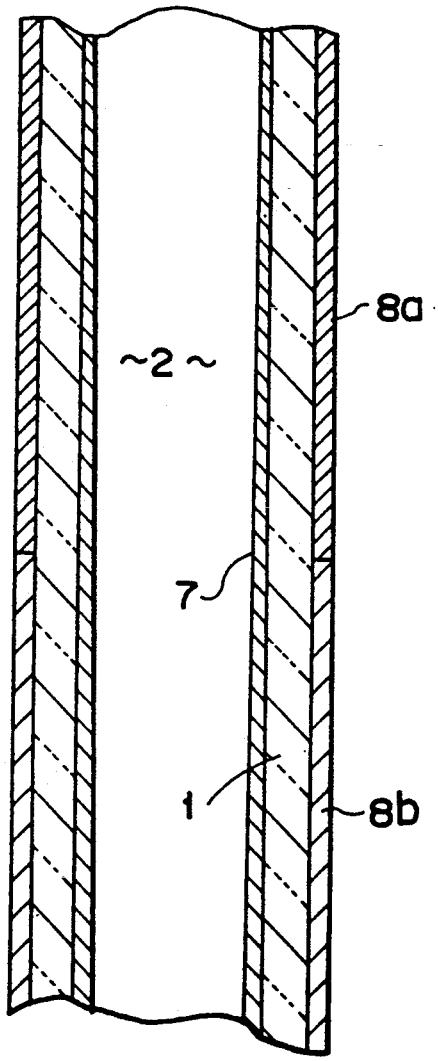
FIG. 4 is a sectional view locally showing the fluorescent lamp of a modified embodiment of the present invention.

Also, it is possible to change the density of the ultraviolet suppressing materials (e.g., $TiO_2$ and ZnO) contained in the ultraviolet suppressing film 8 instead of changing the film thickness. As shown in FIG. 3, the continuous line C shows the ultraviolet output characteristic of a fluorescent lamp having the ultraviolet suppressing film containing 0.3 g of ultraviolet suppressing material. The dotted line D shows the ultraviolet output characteristic of a fluorescent lamp having the ultraviolet suppressing film containing 0.1 g of ultraviolet suppressing material. From FIG. 3, it is found that the amount of ultraviolet light to be output decreases as the density of the ultraviolet suppressing material increases, while the amount of ultraviolet light to be output increases as the density of it decreases. As shown in FIG. 4, ultraviolet suppressing films 8*a* and 8*b* having different density from each other are formed on the outer surface of the bulb 1 by using the above relationship. The ultraviolet suppressing film 8*a* is made of the ultraviolet suppressing material with a large density, while the ultraviolet suppressing film 8*b* is made of the ultraviolet suppressing material with a small density. The ultraviolet suppressing film 8*a* faces the thin portion (upper side in the drawing) of the phosphor film 7 and the ultraviolet suppressing film 8*b* faces the thicker portion (lower side in the drawing) of the phosphor film 7.

Thus, the difference of ultraviolet suppression is allowed between the ultraviolet suppressing films 8*a* and 8*b* according to the difference of the amount of emitted ultraviolet light based on the film thickness difference of the phosphor film 7.

It is also possible to wind a heat shrinkable tube containing ultraviolet suppressing material on the outer surface of the bulb 1.

Figure 5:
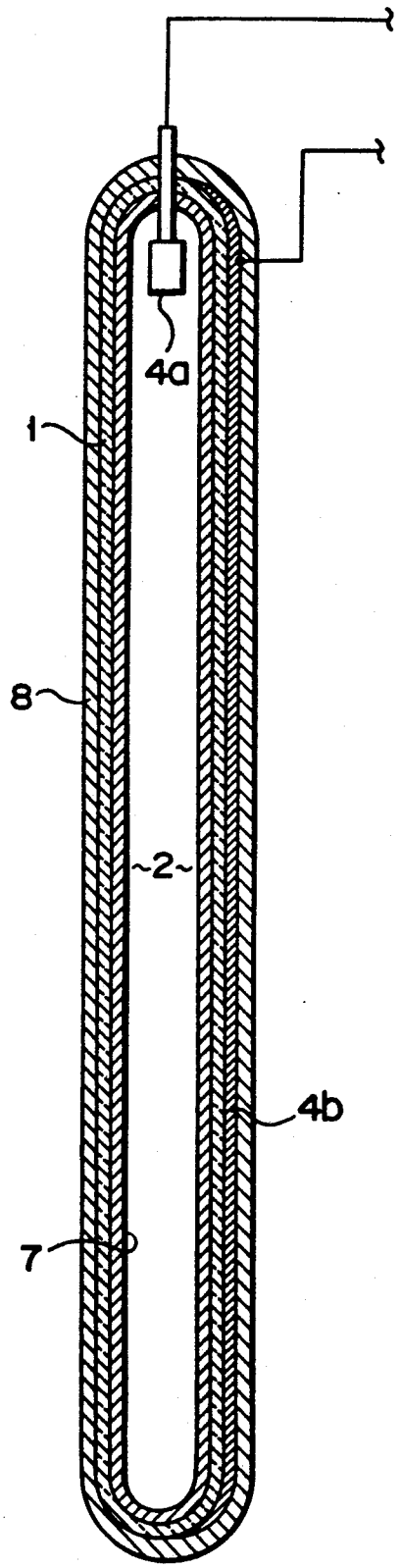
FIG. 5 is a sectional view of the fluorescent lamp of another modified embodiment of the present invention.

It is also possible to form the phosphor film 7 and the ultraviolet suppressing film 8 of said embodiment on the external-electrode-type fluorescent lamp shown in FIG. 5. The fluorescent lamp of this modified embodiment has the bulb 1 provided with a internal electrode 4*a* at its one end. The discharge space 2 is prepared in the bulb 1. The phosphor film 7 is formed on the inner surface of the bulb 1. An external electrode 4*b* is installed on the outer surface of the bulb 1 and the ultraviolet suppressing film 8 is formed on the outer surface of the external electrode 4*b*. The present invention can be applied to the above lamp.

The fluorescent lamp of the second embodiment of the present invention is described below according to FIGS. 6 and 7. The configuration same as that of the fluorescent lamp of the first embodiment is provided with the same symbol and its description is omitted.

Figure 6:
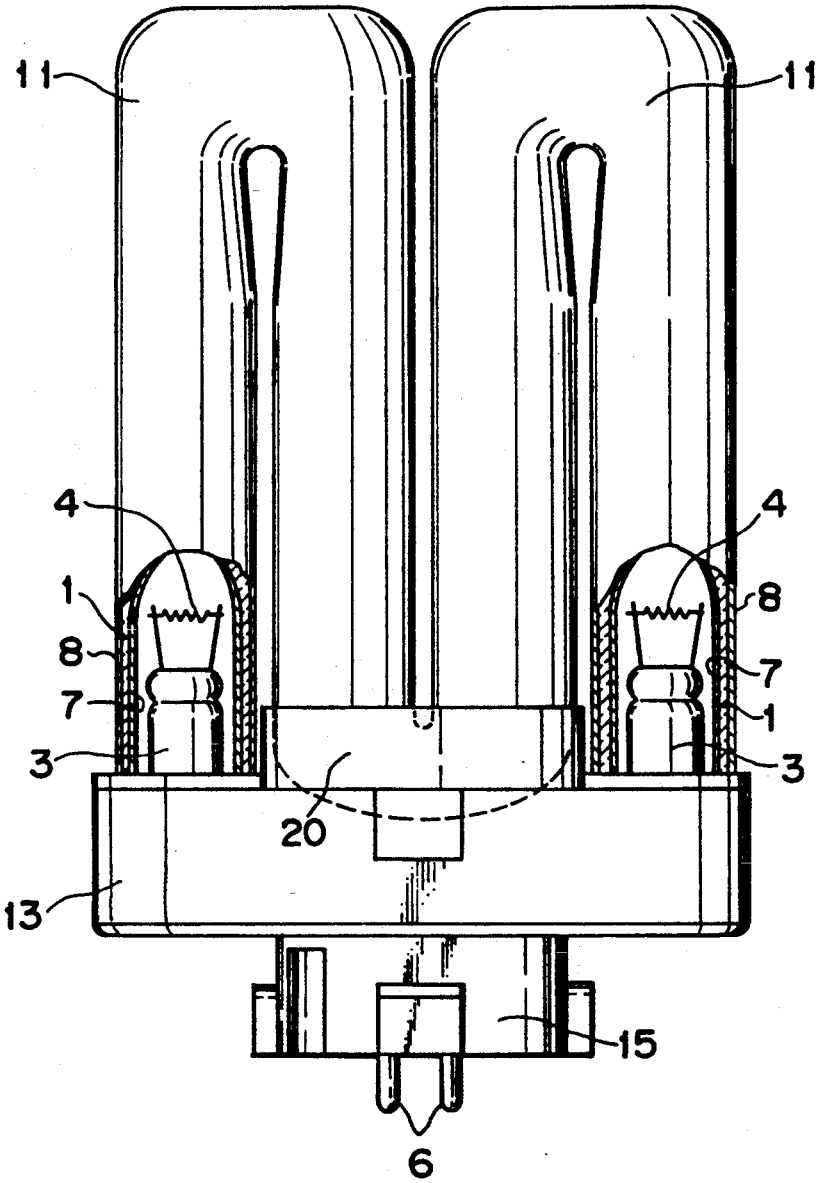
FIG. 6 is a front view showing a part of the fluorescent lamp of the second embodiment of the present invention by cutting out the portion.
Figure 7:
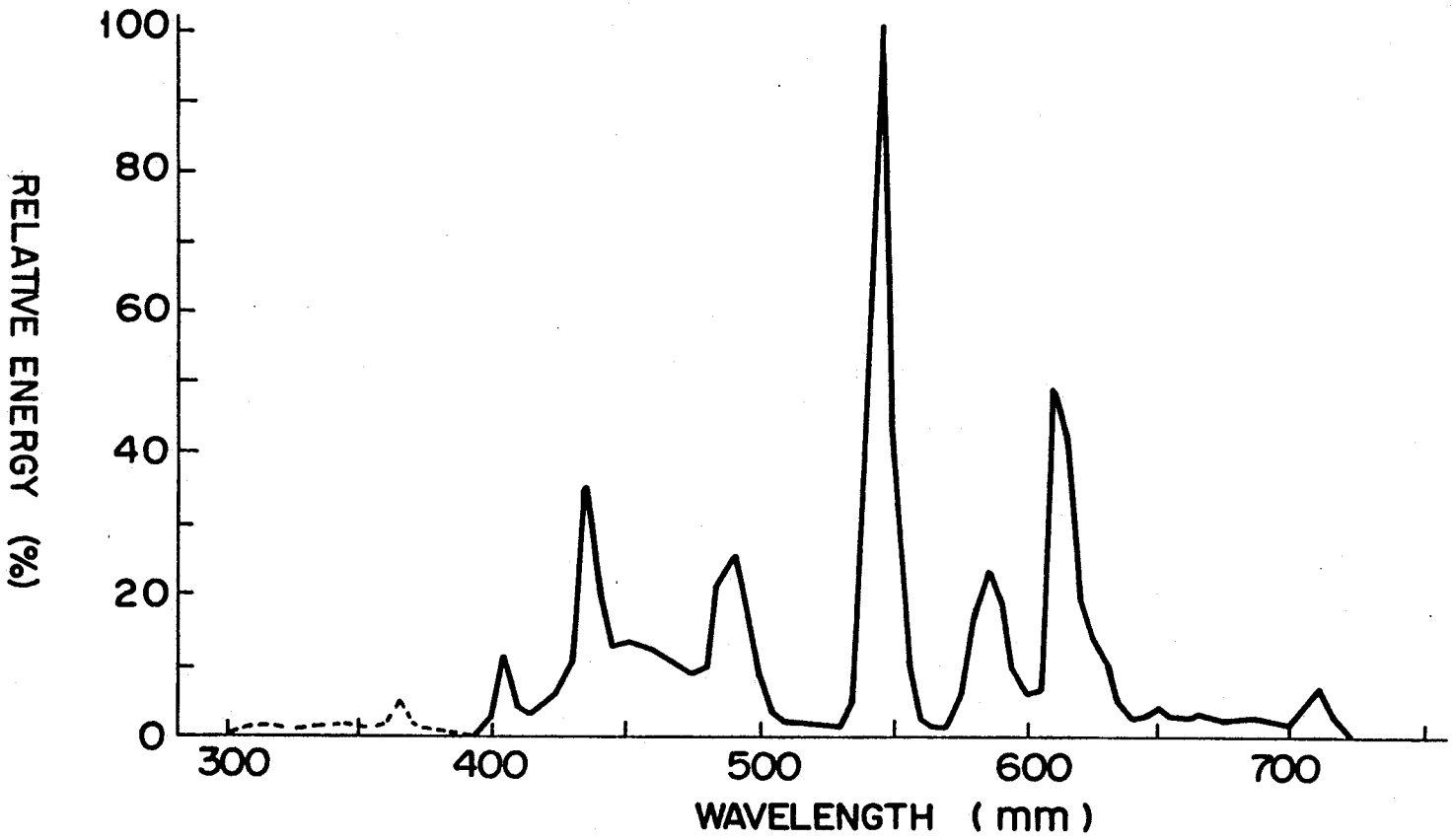
FIG. 7 is a graph showing the relationship between the wavelength output from the fluorescent lamp in FIG. 6 and the relative energy.

As shown in FIG. 6, the fluorescent lamp of the present invention has two U-type bulbs 1 having a bent portion 11 and opening at the both ends. Opening sides of these bulbs 1 are installed on a base 13. One opening of each bulb (the opening at the both outsides in the drawing) is closed by the stem 3 having a filament electrode 4. The ends of the bulb 1 not closed by the stem 3 are connected each other by a U-type connecting section 20. A discharge space is prepared in two U-type bulbs 1 to form a discharge route. The U-type connecting section is behind the base 13. A connecting section 15 is installed on the opposite side (the side opposite to the surface on which said bulb 1 is installed) of the base 13. A pair of pins 6 connected to said filament electrode 4 protrudes from the connecting section 15.

The phosphor film 7 for converting the ultraviolet rays into the visible radiation is formed on the inner surface of the bulb 1. The ultraviolet suppressing film 8 for absorbing the ultraviolet rays penetrating the phosphor film 7 is formed on the outer surface of the bulb 1.

The phosphor film 7 is formed by the following process.

A U-type bulb 1, before the stem 3 is installed and the connecting section 20 is formed, is prepared and said phosphor mixture mixed with three-band fluorescent materials is poured from the opening of the bulb 1. Then, the bulb 1 is held with the bent portion 11 upward. Therefore, the phosphor mixture poured into the bulb 1 drips downward from the opening. In this case, said phosphor mixture is dried by blowing hot air on it from the outside of the bulb 1. Then, the coated film is baked in a baking oven to remove binder or the like and form the phosphor film 7 on the inner surface of the bulb 1.

The phosphor film 7 thus formed is the thinnest at the bent portion 11 and the thickest at the opening. It is the reason why film thickness difference occurs that, similarly to the first embodiment, the film thickness decreases at the U-bent portion which is the upper side and increases at the opening which is the lower side because phosphor mixture runs downward during drying until the solvent is evaporated.

A fluorescent lamp with no base called a wire bulb is made by connecting two U-type bulbs 1 thus formed each other, installing the stem 3 provided with an electrode on the opening at the both ends of the bulb, and filling the bulbs with a small amount of such noble gasses as Hg and argon through the exhaust process. Then, the ultraviolet suppressing film 8 is formed on the outer surface of the bulb 1.

The ultraviolet suppressing film 8 is similarly formed by the following process before the bulb 1 is installed on the base 13.

For example, the ultraviolet suppressing material mixture is prepared which is made by dispersing zinc oxide (ZnO) with the particle diameter of 0.01 μm and titanium oxide ($TiO_2$) with the particle diameter of 0.03 μm into hydrolyzed tetrathoxysilane solution. The bulb 1 is dipped in the ultraviolet suppressing material mixture from the bent portion 11 by holding the lead wire of the bulb. Then, the bulb 1 is raised and held so that the opening will be turned upward to dry the ultraviolet suppressing material mixture. In this case, it is permitted to blow hot air on the bulb 1. Then, the coated film is baked for approx. 20 min to remove binder or the like and form the ultraviolet suppressing film 8 on the outer surface of the bulb 1.

The ultraviolet suppressing film 8 thus formed is the thinnest at the opening and the thickest at the ben portion 11.

This is because, as mentioned above, the film thickness increases at the U-bent portion 11 which is the lower side and decreases at the opening which is the upper side because the ultraviolet suppressing material mixture runs downward during drying until the solvent is evaporated.

Because the bulb 1 is held inversely when the phosphor film 7 is formed, the thickness of the ultraviolet suppressing film 8 increases at the U-bent portion 11 where the phosphor film 7 is thin and decreases at the opening where it is thick.

When the base 13 is installed on the fluorescent lamp thus formed, the lamp is finished.

It is also possible to form the ultraviolet suppressing film 8 after the base 13 is installed. In this case, since the base 13 is generally made o synthetic resin which is easily deteriorated by ultraviolet light, the ultraviolet suppressing film 8 should also be provided on the surface of the base 13 to prevent the deterioration of the base 13. The ultraviolet suppressing film 8 should be baked for a long time at a low temperature so that the base 13 will not be thermally deformed.

The following table shows the ratio of the amount of emitted ultraviolet light to the total amount of produced ultraviolet light and that of the irradiated amount of light to the total amount of light emitted from the fluorescent lamp when the ultraviolet suppressing film 8 is made by various processes.

In this table, each experimental result is expressed assuming that the amount of emitted ultraviolet light and the irradiated amount of light are individually 100% in comparison example "a" which is taken as a reference. The comparison example "a" shows the case in which the ultraviolet suppressing film 8 is not formed.

TABLE

| | Thickness of Ultraviolet absorbing (μm) | | | Amount of ultraviolet (%) | Amount of light (%) |
|---|---|---|---|---|---|
| | Bent portion | Middle | Opening side | | |
| Example | | | | | |
| A | 5 | 3 | 1 | 0.5 | 99 |
| B | 10 | 6 | 2 | 0.1 | 98 |
| Comparison Example | | | | | |
| a | — | — | — | 100 | 100 |
| b | 1 | 3 | 5 | 5 | 98 |
| c | 3 | 6 | 10 | 0.5 | 96 |
| d | 3 | 3 | 3 | 0.5 | 97 |

In this table, the example A shows the case in which the bulb 1 is dipped in the ultraviolet suppressing material mixture once from the bent portion 11. For the example A, the ultraviolet suppressing film 8 formed on the outer surface of the bulb 1 is the thickest at the bent portion 11 and the thinnest at the opening. In this case, most of the ultraviolet with the wavelength of 380 nm of less (see FIG. 7) is suppressed, that is, only 0.5% of the total amount of produced ultraviolet light in the bulb 1 is emitted and 99% of the total amount of light is irradiated.

The example B shows the case in which the bulb 1 is dipped in the ultraviolet suppressing material mixture twice. For the example B, the ultraviolet suppressing film 8 has the thickness two times as thick as the film in said example A. As the result, the mount of emitted ultraviolet light greatly decreases and the amount of irradiated light slightly decreases.

Comparison examples "a" through "d" show the case in which the bulb 1 is dipped in the ultraviolet suppressing material mixture from the opening. The phosphor film 7, as previously mentioned, is the thinnest at the bent portion 11 and the thickest at the opening.

The comparison example "b" shows the case in which the bulb 1 is dipped in the mixture once. For this comparison example, the formed ultraviolet suppressing film 8 is the thinnest at the bent portion 11 and the thickest at the opening. Therefore, the thicknesses of the ultraviolet suppressing film 8 and the phosphor film 7 are the thinnest at the bent portion 11. Consequently, the amount of ultraviolet light emitted from the bent portion 11 is four times as much as that emitted from the opening.

The comparison example "c" shows the case in which the bulb 1 is dipped in the mixture twice. For the comparison example "c", the formed ultraviolet suppressing film 8 has the thickness two times as large as that of the comparison example "b". Consequently, the amount of emitted ultraviolet decreases. However, because the ultraviolet suppressing film 8 slightly suppresses visible radiation, the amount of irradiated light decreases.

The comparison example "d" shows the case in which the bulb 1 is first dipped in the ultraviolet suppressing material mixture from the opening by turning the bent portion 11 upward and then dipped in the ultraviolet suppressing material mixture from the ben portion 11 by turning the opening upward. For the comparison example "d", the formed ultraviolet suppressing film 8 has the uniform thickness in the axis direction of the bulb 1. In the comparison example "d', similarly to the comparison example "c", the amount of emitted ultraviolet light and that of irradiated light decrease.

For the fluorescent lamp of this embodiment, as mentioned above, the ultraviolet suppressing film 8 facing the thin portion of the phosphor film 7 is thickly formed while the ultraviolet suppressing film 8 facing the thick portion of the phosphor film 7 is thinly formed.

As the result, the ultraviolet light penetrating the thin portion of the phosphor film 7 is adequately suppressed by the ultraviolet suppressing film 8. Therefore, no ultraviolet light is emitted to the outside. In this thick portion of the phosphor film 7, ultraviolet light is adequately suppressed by even thinly-formed ultraviolet suppressing film 8 because only a small of amount ultraviolet light penetrates the portion. As the result, no ultraviolet light is emitted to the outside. Moreover, the light output does not decrease because the thickness of the phosphor film 7 and that of the ultraviolet suppressing film 8 are not extremely large.

When the ultraviolet suppressing film 8 is formed in said embodiment, the bulb is dipped in the ultraviolet suppressing material by turning the bent portion 11 downward and dried with the bent portion 11 downward. Therefore, the lead wire is not contaminated by the mixture. As the result, imperfect insulation is prevented when the wire is electrically connected to the pin 6 of the base 13. Moreover, when the base 13 is installed on the bulb 1 before the ultraviolet suppressing film 8 is formed, it is further effective because the lead wire is not contaminated.

Figure 8:
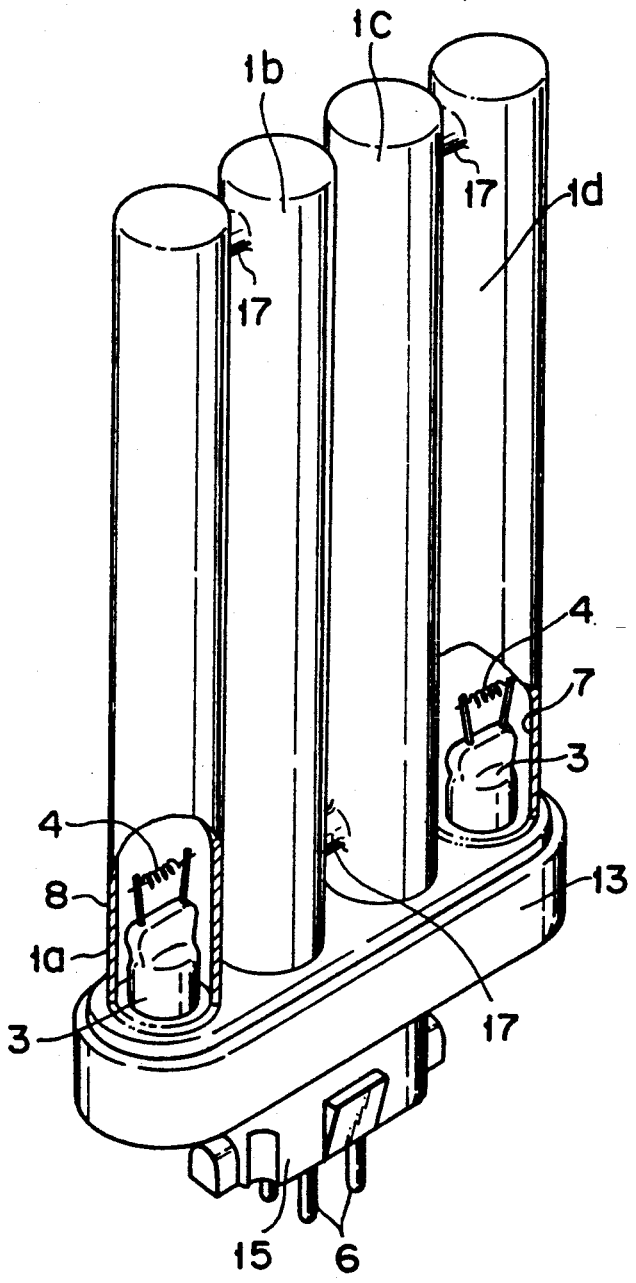
FIG. 8 is a perspective view showing a modified embodiment of the fluorescent lamp in FIG. 6.

This embodiment is not restricted to the above configuration. For example, the fluorescent lamp with the configuration shown in FIG. 8 is allowed. The configuration same as that of the fluorescent lamp of said second embodiment is provided with the same symbol and its description is omitted.

The fluorescent lamp of this modified embodiment has four cylindrical glass bulbs 1*a*, 1*b*, 1*c*, and 1*d*. Each of these bulbs 1*a* through 1*d* is closed at one end and open at the other end. Openings of these bulbs 1*a*-through 1*d* are installed on the base 13 in parallel. The closed side of the first bulb 1*a* is connected with that of the second bulb 1*b* by a glass tube 17. The open side of the second bulb 1*b* is connected with that of the third bulb 1*c* by a glass tube 17. The closed side of the third bulb 1*c* is connected with that of the fourth bulb 1*d* by a glass tube 17.

The phosphor film 7 for converting ultraviolet light into visible radiation is formed on the inner surface of the bulb 1. The ultraviolet suppressing film 8 for absorbing the ultraviolet penetration the phosphor film 7 is formed on the outer surface of the bulb 1.

The phosphor film 7 is formed similarly the above-mentioned second embodiment, which is the thinnest at the closed side and the thickest at the open side.

The ultraviolet suppressing film 8 is dipped in said ultraviolet suppressing material mixture from the closed side of the bulb. Then, the bulb is held so that the closed side will be turned downward and dried. Therefore, the ultraviolet suppressing film 8 thus formed is the thinnest at the open side and the thickest at the closed side.

As the result, the ultraviolet suppressing film 8 facing the thin portion of the phosphor film 7 is thickly formed while the ultraviolet suppressing film 8 facing the thick portion of the phosphor film 7 is thinly formed.

The bulb shape is not restricted to the U-type. So-called W-type bulb and ring bulb are allowed.

The electric-discharge gas is not restricted to Hg. The present invention can also be applied to an electric-discharge lamp which emits visible radiation by filling the bulb with Xe gas instead of Hg and exciting the phosphor with the ultraviolet light emitted by the Xe gas.

Moreover, it is possible to form the ultraviolet suppressing film on the inner surface of the bulb 1.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A fluorescent lamp comprising:

a bulb having an outer surface and an inner surface;

discharge gas contained in said bulb and generating ultraviolet rays by a discharge thereof;

a pair of electrodes provided in said bulb for generating said discharge;

a phosphor film formed on the inner surface of said bulb and having a non-uniform thickness, said phosphor film having a relatively thick portion and a relatively thin portion; and an ultraviolet suppressing film formed on the outer surface of the bulb for suppressing said ultraviolet rays and decreasing ultraviolet ray intensity emitted from said ultraviolet suppressing film, said ultraviolet suppressing film including a first portion having a relatively high ability for suppressing said ultraviolet rays and a second portion having a relatively low ability for suppressing said ultraviolet rays, said first portion disposed on said bulb so to face said thin portion of said phosphor film, said second portion disposed on said bulb so as to face said thick portion of said phosphor film.

2. A fluorescent lamp according to claim 1, wherein said ultraviolet suppressing film contains metal oxide grains absorbing said ultraviolet rays.

3. A fluorescent lamp according to claim 1, wherein said ultraviolet suppressing film contains metal oxide grains suppressing said ultraviolet rays, said first portion of said ultraviolet suppressing film has a high density of said metal oxide grains, and said second portion of said ultraviolet suppressing film has a low density of said metal oxide grains as compared with each other.

4. A fluorescent lamp according to claim 1, wherein said first portion of said ultraviolet suppressing film is thick, and said second portion of said ultraviolet suppressing film is thin as compared with each other.

5. A fluorescent lamp according to claim 1, wherein said bulb has a first end and a second end, and said phosphor film is the thinnest at first end of said bulb and the thickest at the the second end thereof, and said ultraviolet suppressing film is the thickest at first end of said bulb and the thinnest at the second end thereof.

6. A fluorescent lamp according to claim 1, wherein said bulb is straight and has a first end and a second end, said phosphor film has a thickness varying gradually along an axis of said bulb so that said phosphor film has a minimum thickness at said first end and a maximum thickness at said second end, and said ultraviolet suppressing film has a thickness varying gradually along said axis of said bulb so that said ultraviolet suppressing film has a maximum thickness at said first end and minimum thickness at said second end.

7. A fluorescent lamp according to claim 1, wherein said bulb has a non-straight configuration including a plurality of straight portions and a connecting portion connecting said plurality of straight portions and forms a convoluted discharge path therein, said pair of electrodes are located, at a side opposite to said connecting portion of said bulb side by side, said phosphor film has a thickness varying along said discharge path so that said phosphor film has a minimum thickness near said connecting portion of said bulb and a maximum thickness near said side, and said ultraviolet suppressing film has a thickness varying along said discharge path so that said ultraviolet suppressing film has a maximum thickness near said connecting portion of said bulb and a minimum thickness at said near said side.

8. A fluorescent lamp according to claim 1, wherein said ultraviolet suppressing film includes at least one of titanium oxide ($TiO_2$) and zinc oxide (ZnO).

9. A method for manufacturing a fluorescent lamp having a straight bulb having a first end and a second end, a discharge gas contained in said bulb and generating ultraviolet rays by a discharge thereof, a pair of electrodes provided to said bulb at both ends, a phosphor film formed on the inner surface of said bulb and having a thickness which varys gradually along an axis of said bulb so that said phosphor film has a minimum thickness at said first end and a maximum thickness at said second end, and an ultraviolet suppressing film for suppressing said ultraviolet rays formed to be faced with said phosphor film and having a thickness varying gradually along said axis of said bulb so that said ultraviolet suppressing film has a maximum thickness at said first end and a minimum thickness at said second end, comprising:

a step for drying a phosphor mixture coated inside of said bulb while said second end of said bulb is kept upward so as to form said phosphor film; and a step for drying an ultraviolet suppressing material mixture coated outside of said bulb while said first end of said bulb is kept upward so as to form said ultraviolet suppressing film.

10. A method for manufacturing a fluorescent lamp having a bulb having a non-straight configuration including a plurality of straight portions and a connecting portion connecting said plurality of straight portions and forming a convoluted discharge path therein a discharge gas contained in said bulb and generating ultraviolet rays by a discharge thereof, a pair of electrodes, provided to said bulb and located at a side opposite to said connecting portion of said bulb side by side, a phosphor film having a thickness which varys along said discharge path so that said phosphor film has a minimum thickness near said connecting portion of said bulb and a maximum thickness near said side, and an ultraviolet suppressing film having a thickness which varys along said discharge path so that said ultraviolet suppressing film has a maximum thickness near said connecting portion of said bulb and a minimum thickness near said side, comprising:

a step for drying a phosphor mixture coated on the inside of said bulb while said connecting portion of said bulb is kept upward so as to form said phosphor film; and a step for drying an ultraviolet suppressing material mixture coated of said bulb while said side of said bulb is kept upward so as to form said ultraviolet suppressing film.

11. A method for manufacturing a fluorescent lamp according to claim 10, wherein said ultraviolet suppressing film is coated on the outside of said bulb by a step of dipping said bulb in said ultraviolet suppressing material mixture while said side of said bulb is kept upward.

* * * * *